US011839306B2

(12) United States Patent
Valone

(10) Patent No.: US 11,839,306 B2
(45) Date of Patent: Dec. 12, 2023

(54) MURPHY BED CHEST

(71) Applicant: ATLANTIC FURNITURE, INC., South Deerfield, MA (US)

(72) Inventor: Mark Valone, South Deerfield, MA (US)

(73) Assignee: ATLANTIC FURNITURE, INC., South Deerfield, MA (US)

( * ) Notice: Subject to any disclaimer, the term of this patent is extended or adjusted under 35 U.S.C. 154(b) by 87 days.

(21) Appl. No.: 16/115,035

(22) Filed: Aug. 28, 2018

(65) Prior Publication Data

US 2020/0069067 A1 Mar. 5, 2020

(51) Int. Cl.
*A47C 17/60* (2006.01)
*A47C 19/12* (2006.01)
*A47C 17/58* (2006.01)

(52) U.S. Cl.
CPC ..... *A47C 17/60* (2013.01); *A47C 17/58* (2013.01); *A47C 19/12* (2013.01)

(58) Field of Classification Search
CPC ..... A47C 17/60; A47C 17/58; A47C 19/12
USPC ..... 5/159.1
See application file for complete search history.

(56) References Cited

U.S. PATENT DOCUMENTS 218,678 A 8/1879 Koskul
239,805 A * 4/1881 Knapp ..... A47C 17/56 5/159.1
319,083 A 6/1885 Farrar
411,641 A * 9/1889 Brown ..... A47C 17/40 5/143
445,777 A 2/1891 Goodwillie
791,857 A * 6/1905 Arnold ..... A47C 17/40 5/164.1
1,081,590 A * 12/1913 Dyke ..... A47C 17/32 5/55.1
1,170,149 A * 2/1916 Gustafson ..... A47C 17/48 5/157
2,356,321 A * 8/1944 Irick ..... A47C 17/60 5/152
2,487,401 A * 11/1949 Turner ..... A47B 3/0815 403/92

(Continued)

FOREIGN PATENT DOCUMENTS

DE 202016105145 U1 12/2016
KR 1020070058791 A 6/2007

OTHER PUBLICATIONS

International Search Report for International Application No. PCT/US2019/048449; International Filing Date Aug. 28, 2019; dated Nov. 21, 2019; 6 Pages.

(Continued)

*Primary Examiner* — Myles A Throop
(74) *Attorney, Agent, or Firm* — CANTOR COLBURN LLP

(57) ABSTRACT

A folding bed chest system includes a cabinet having a front panel assembly movable from a closed position to an opened position, wherein when in the open position the front panel assembly is supportive of a mattress located thereon. A drawer assembly is freely movable into and out of a drawer opening located below the front panel assembly. The drawer assembly is configured such that the front panel assembly is movable from the closed position to the opened position when the drawer assembly is located fully in the drawer opening.

13 Claims, 9 Drawing Sheets

(56) References Cited

U.S. PATENT DOCUMENTS

| | | | | | |
|---|---|---|---|---|---|
| 3,097,369 | A * | 7/1963 | Emch | A47C 17/40 | 5/136 |
| 3,195,968 | A | 7/1965 | Freeman | | |
| 3,612,289 | A | 10/1971 | Zink | | |
| 3,858,253 | A * | 1/1975 | Lauzon | A47C 17/62 | 5/2.1 |
| 4,176,890 | A * | 12/1979 | Gorton | A47B 88/487 | 312/334.41 |
| 4,288,137 | A * | 9/1981 | MacDonald | A47B 88/487 | 312/334.45 |
| 4,580,851 | A * | 4/1986 | Nelson | A47B 88/487 | 384/19 |
| 4,793,011 | A * | 12/1988 | Eve | A47C 17/58 | 5/136 |
| 5,033,134 | A * | 7/1991 | Burchett | A47C 17/52 | 5/133 |
| 5,536,083 | A * | 7/1996 | Brustle | A47B 88/443 | 312/334.6 |
| 6,088,849 | A * | 7/2000 | Lieber | A47B 85/08 | 312/315 |
| 6,851,139 | B2 | 2/2005 | Arason et al. | | |
| 7,574,758 | B2 | 8/2009 | Arason et al. | | |
| 7,976,112 | B2 * | 7/2011 | Stock | A47B 88/483 | 312/334.7 |
| 8,006,327 | B1 * | 8/2011 | Burchett | A47C 17/38 | 5/133 |
| D712,676 | S | 9/2014 | Flora | | |
| D742,136 | S | 11/2015 | Flora | | |
| 9,468,305 | B2 | 10/2016 | Flora | | |
| 9,743,775 | B2 * | 8/2017 | Grubb | A47C 17/52 | |
| D814,830 | S | 4/2018 | Flora | | |
| D884,395 | S * | 5/2020 | Flora | D6/663 | |
| 11,324,327 | B2 * | 5/2022 | Grossman | A47C 17/54 | |
| 2006/0031986 | A1 * | 2/2006 | Revels | A47C 17/38 | 5/136 |
| 2006/0225210 | A1 * | 10/2006 | Arason | A47C 17/48 | 5/159.1 |
| 2007/0029905 | A1 * | 2/2007 | Shapiro | A47B 96/025 | 312/351 |
| 2015/0362278 | A1 * | 12/2015 | Genchel | F16M 11/32 | 42/94 |
| 2016/0022048 | A1 * | 1/2016 | Flora | A47C 17/60 | 5/149 |
| 2016/0037934 | A1 * | 2/2016 | Porter | A47C 17/58 | 5/174 |
| 2017/0007028 | A1 | 1/2017 | Grubb | | |
| 2018/0161225 | A1 * | 6/2018 | Zerhusen | A61G 7/0536 | |
| 2019/0191889 | A1 * | 6/2019 | Flora | A47C 19/122 | |

OTHER PUBLICATIONS

Written Opinion for International Application No. PCT/US2019/048449; International Filing Date Aug. 28, 2019; dated Nov. 21, 2019; 7 Pages.

* cited by examiner

MURPHY BED CHEST

BACKGROUND

Exemplary embodiments pertain to the art of folding beds, and more particularly to folding beds that, in the stored position, are enclosed in a cabinet or similar furniture.

Traditional beds take up a large amount of floor space in the room that the bed is placed. When the beds are not used frequently, and/or when the bed is located in a small room or a room in which the space for the bed could be otherwise utilized, a folding bed is one solution to allow for other use of the space in the room when the bed is not needed.

Some folding beds are folded away into a cabinet or other similar furniture article when not in use. Such Murphy bed chests are attractive pieces of furniture when the bed is in a folded position, and a comfortable bed when needed and transformed into an opened position where at least a portion of the furniture article is a sleeping platform supportive of a mattress. Some Murphy bed chests, however, are heavy, are cumbersome to move between the closed position and the opened position, and offer limited storage or limited access to storage, especially when the bed is in the opened position.

BRIEF DESCRIPTION

In one embodiment a folding bed chest system includes a chest assembly having two opposing side panels spaced apart by a distance, and a front panel assembly connected to the chest assembly by one or more primary hinges. The front panel assembly is movable between an upright closed position and an opened position, such that when in the opened position the front panel assembly is configured to be supportive of a mattress. The front panel assembly, includes an upper front panel rotatably connected to the front panel assembly. The upper front panel extends from and is supportive of the front panel assembly when the front panel assembly is in the opened position. The folding bed chest system further includes a frame including a main frame portion, a footboard frame connected to the main frame by one or more secondary hinges, and a footboard leg extending from the footboard frame and supportive of the footboard frame when the front panel assembly is in the opened position. A drawer assembly is freely movable into and out of a drawer opening located below the front panel assembly and between the opposing side panels. The drawer assembly is configured such that the front panel assembly is movable from the closed position to the opened position when the drawer assembly is located fully in the drawer opening.

Additionally or alternatively, in this or other embodiments the drawer assembly includes opposing drawer side panels defining a drawer width, the drawer width less than a drawer opening width, and a drawer guide extending laterally outwardly from each of the drawer side panels. The drawer guide is interactive with a side of the drawer opening to guide the drawer assembly into the drawer opening.

Additionally or alternatively, in this or other embodiments the drawer assembly further includes one or more wheels affixed to the drawer assembly.

Additionally or alternatively, in this or other embodiments a shelf extends between the opposing side panels.

Additionally or alternatively, in this or other embodiments the shelf is at least partially supportive of the mattress.

Additionally or alternatively, in this or other embodiments the drawer is movable between a drawer closed position fully in the drawer opening and a drawer opened position fully outside of the drawer opening when the front panel assembly is in the opened position.

Additionally or alternatively, in this or other embodiments one or more retainers retain the footboard leg at the footboard frame when the front panel assembly is in the closed position.

Additionally or alternatively, in this or other embodiments the one or more retainers are one or more magnets.

Additionally or alternatively, in this or other embodiments a latch assembly extends between the side panel and the front panel assembly to retain the front panel assembly in the closed position.

The folding bed chest system of claim 1, further comprising a brace retains the upper front panel in the extended position.

Additionally or alternatively, in this or other embodiments a charging station is located at a side panel. The charging station includes one or more electrical power outlets and/or one or more USB ports for connecting one or more electronic devices thereto.

Additionally or alternatively, in this or other embodiments the one or more primary hinges are located at a front rail extending between the two opposing side panels.

In another embodiment, a folding bed chest system includes a cabinet having a front panel assembly movable from a closed position to an opened position, wherein when in the open position the front panel assembly is supportive of a mattress located thereon. A drawer assembly is freely movable into and out of a drawer opening located below the front panel assembly. The drawer assembly is configured such that the front panel assembly is movable from the closed position to the opened position when the drawer assembly is located fully in the drawer opening.

Additionally or alternatively, in this or other embodiments the drawer assembly includes opposing drawer side panels defining a drawer width, the drawer width less than a drawer opening width, and a drawer guide extending laterally outwardly from each of the drawer side panels, the drawer guide interactive with a side of the drawer opening to guide the drawer assembly into the drawer opening.

Additionally or alternatively, in this or other embodiments the drawer assembly further includes one or more wheels affixed to the drawer assembly.

Additionally or alternatively, in this or other embodiments a shelf is located in the cabinet. The shelf is at least partially supportive of the mattress.

Additionally or alternatively, in this or other embodiments the drawer is movable between a drawer closed position fully in the drawer opening and a drawer opened position fully outside of the drawer opening when the front panel assembly is in the opened position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
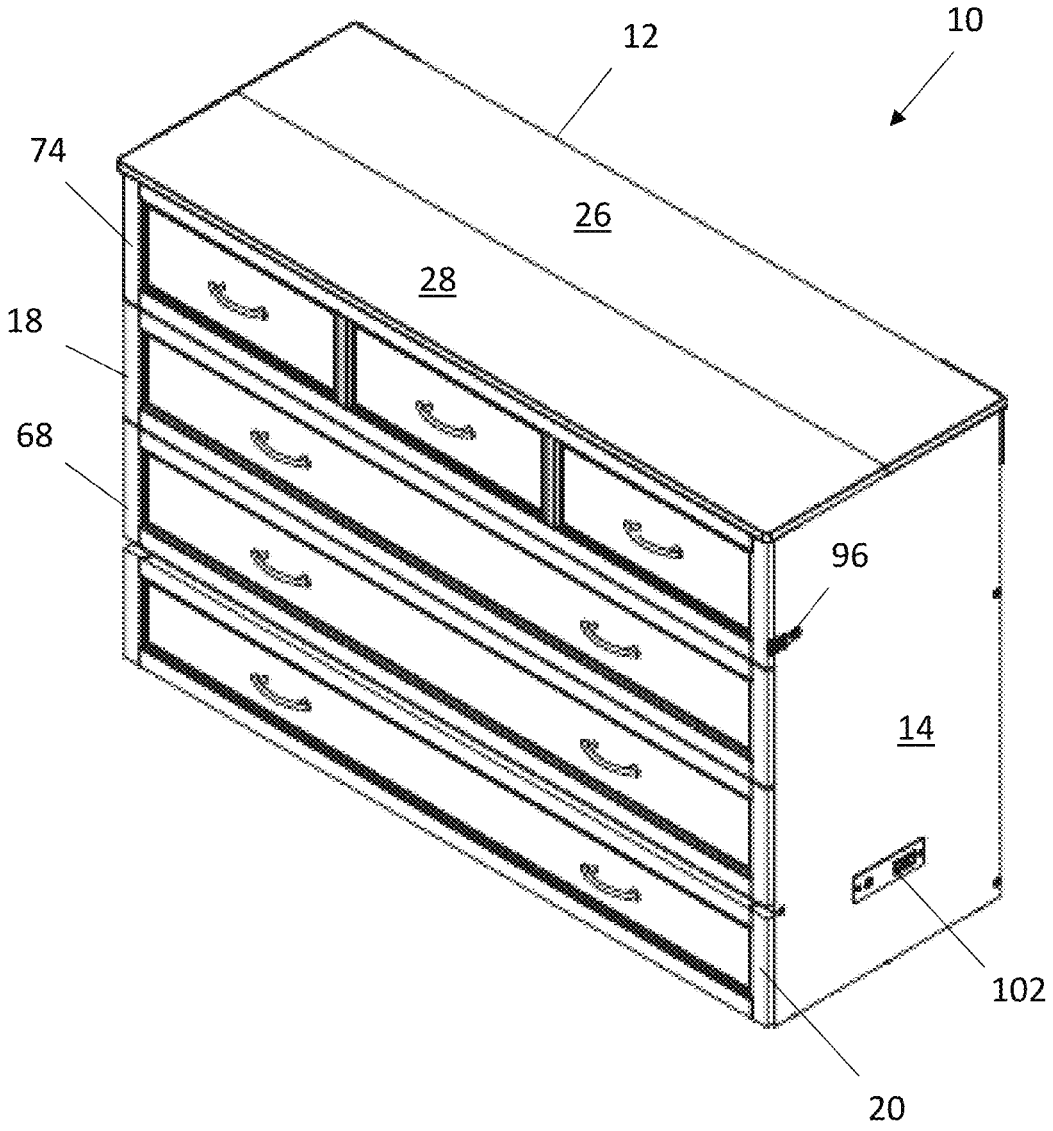
FIG. 1 is an illustration of an embodiment of a Murphy bed chest in a closed position.
Figure 2:
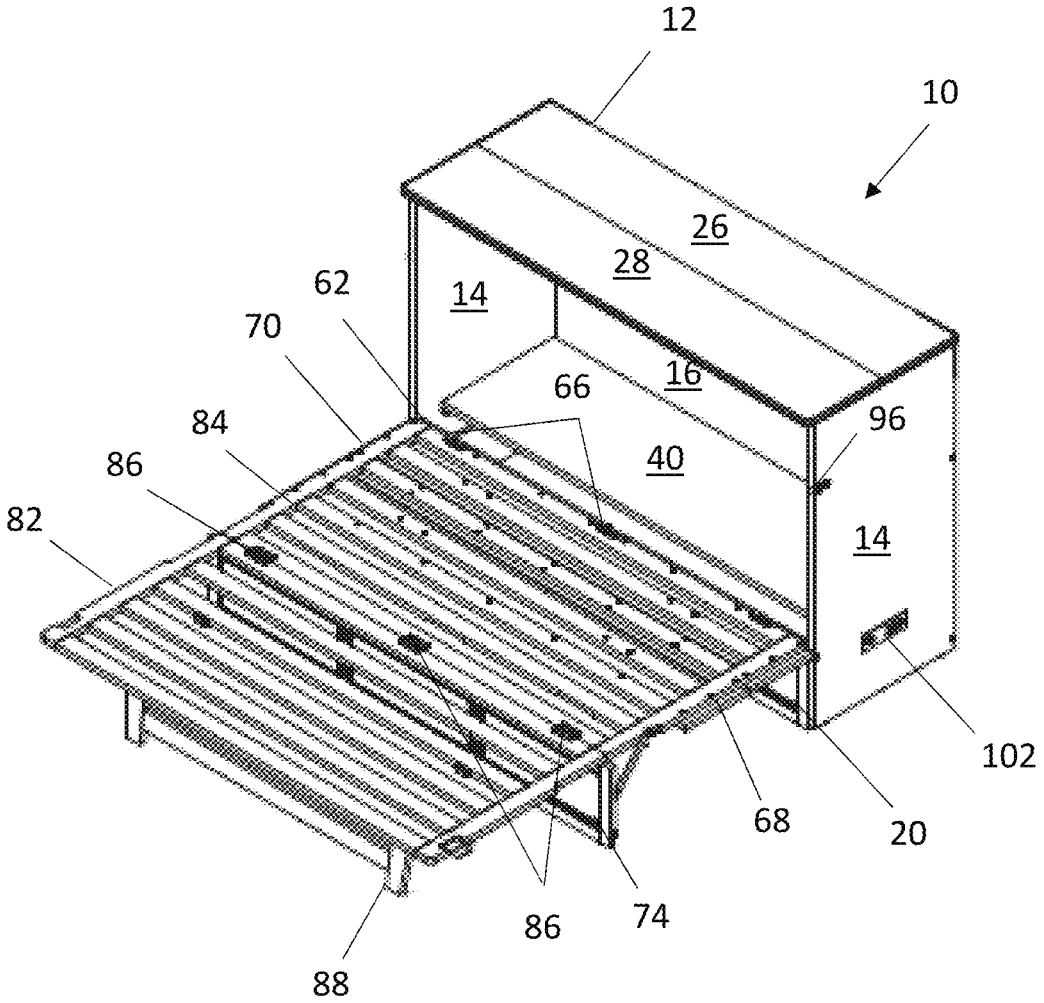
FIG. 2 is an illustration of an embodiment of a Murphy bed chest in an opened position.
Figure 3:
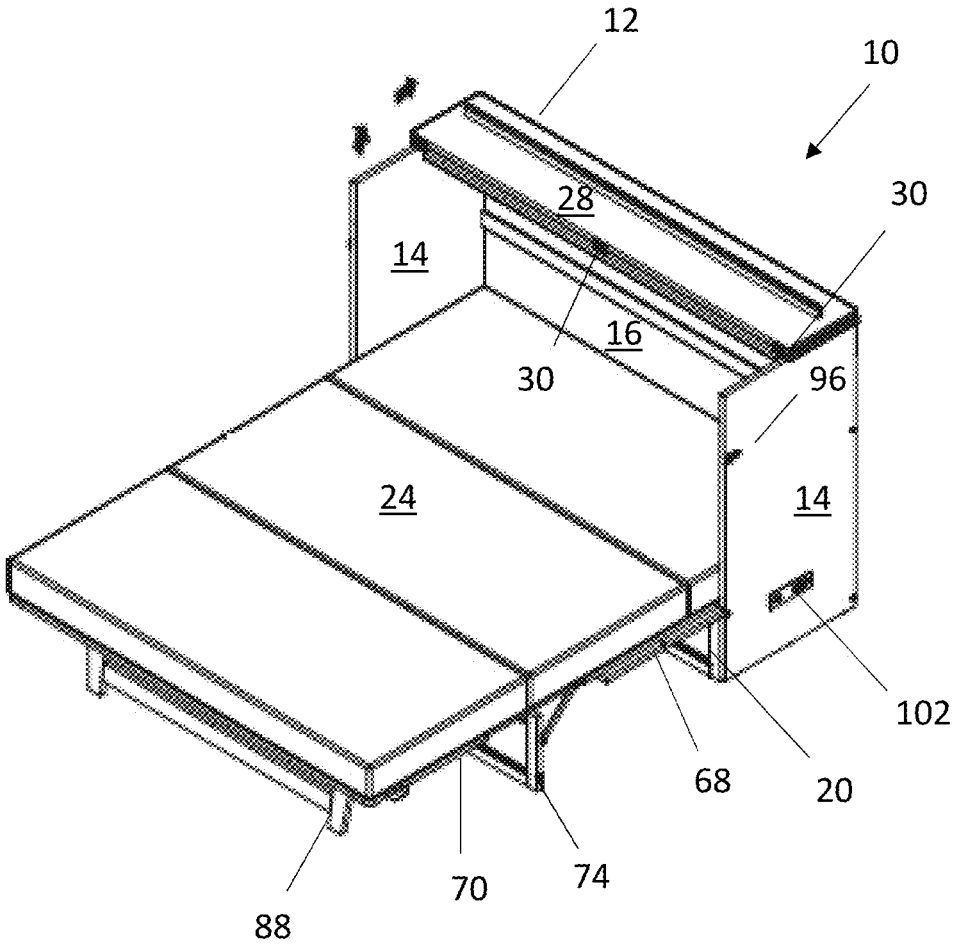
FIG. 3 is an illustration of an embodiment of a Murphy bed chest in an opened position with a mattress installed.

Referring now to FIGS. 1 and 2, shown is an embodiment of a Murphy bed chest 10 shown in a closed position (in FIG. 1) and an opened position (in FIG. 2). The Murphy bed chest 10 includes a top panel assembly 12, opposing side panels 14, and a back panel assembly 16. The Murphy bed chest 10 further includes a hinged front panel assembly 18 and a drawer assembly 20 located beneath the front panel assembly 18. Generally, and as will be explained in greater detail below, when moved to the opened position, the front panel assembly 18 defines a supported platform 22 for placement of a folding mattress 24, as shown in FIG. 3.

Referring again to FIGS. 1 and 2, the top panel assembly 12 includes a first top panel 26 and a second top panel 28. The first top panel 26 is fixedly located at the opposing side panels 14 and the back panel assembly 16. The second top panel 28 is secured to the first top panel 26 via one or more top panel hinges 30, such that the second top panel 28 is movable to atop the first top panel 26 when the Murphy bed chest 10 is opened, as shown in FIG. 3. This provides added head room for a person using the Murphy bed chest 10.

Figure 4:
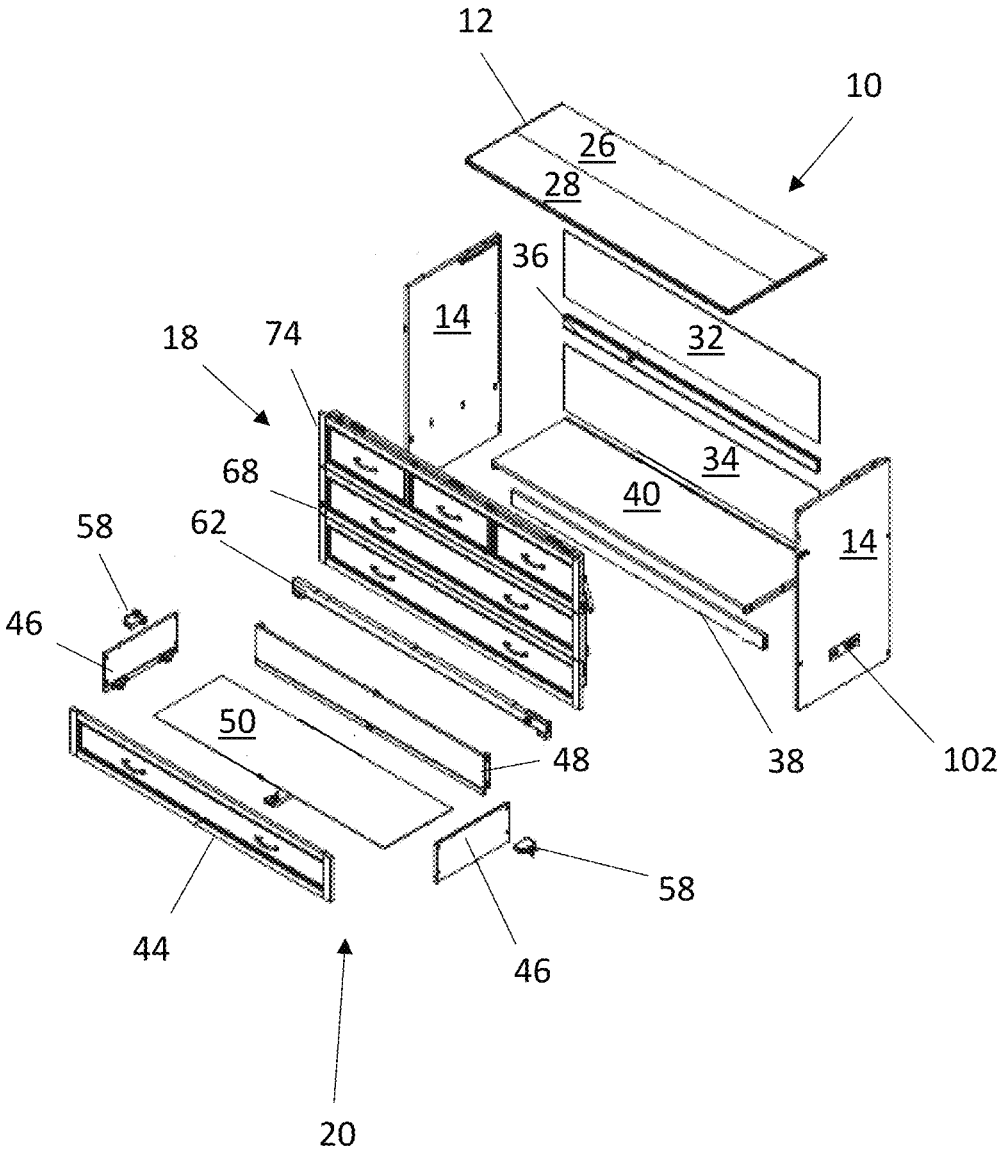
FIG. 4 is a partially exploded view of an embodiment of a Murphy bed chest.

Referring to the exploded view of FIG. 4, in some embodiments the back panel assembly 16 includes an upper back panel 32 and a lower back panel 34 which are connected and supported by a back panel middle rail 36 located between the upper back panel 32 and the lower back panel 34 and a back panel lower rail 38 disposed below the lower back panel 34. Further, the Murphy bed chest 10 includes a shelf 40 resting on the lower back panel rail 38 and extending between the opposing side panels 14.

Figure 5:
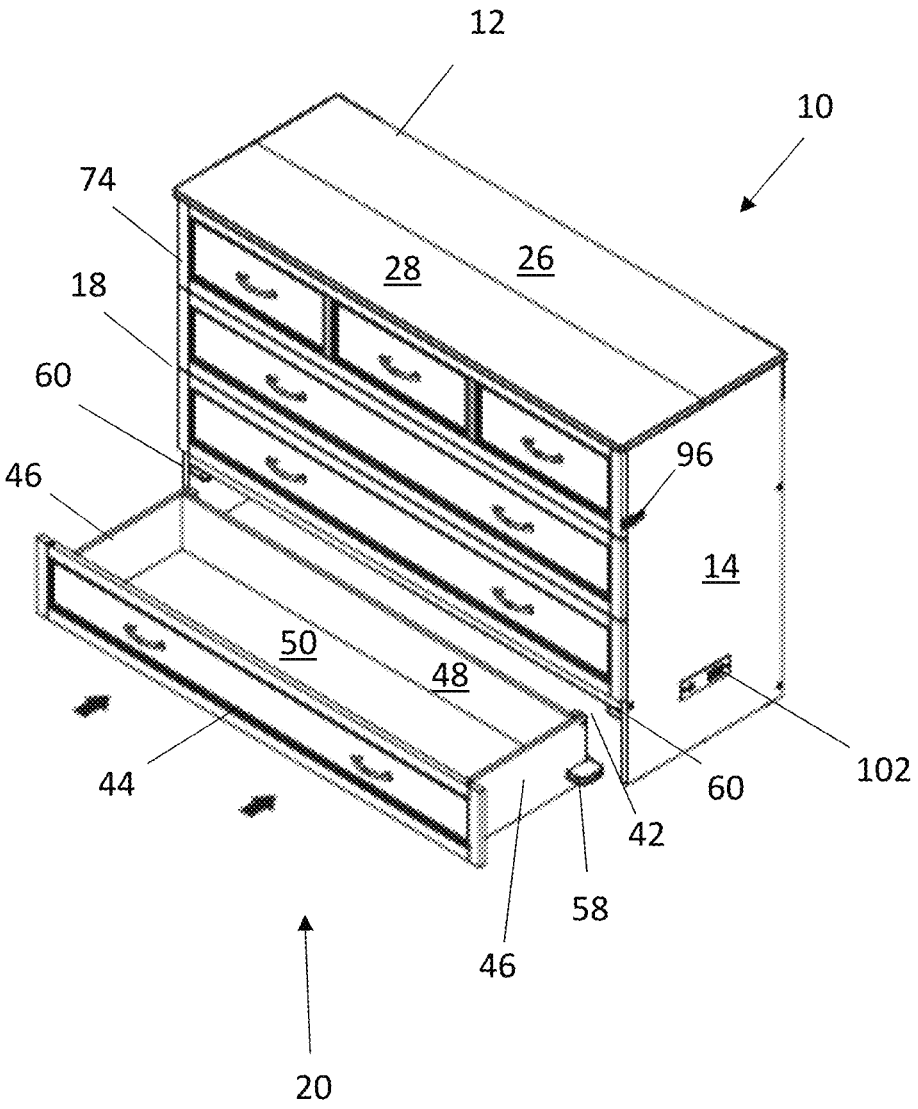
FIG. 5 is an illustration of an embodiment of a Murphy bed chest with a drawer in an open position.
Figure 6:
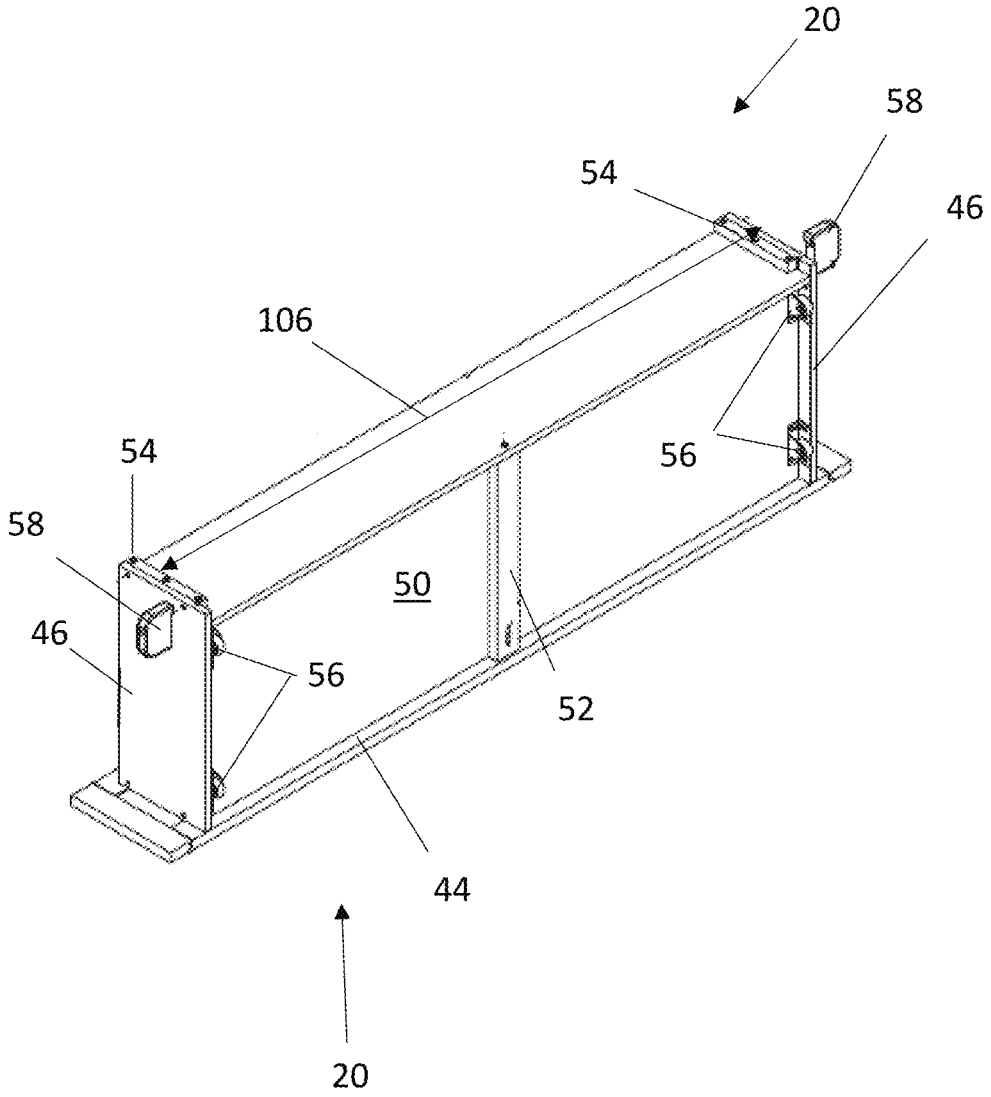
FIG. 6 is an illustration of an embodiment of a drawer of a Murphy bed chest.

Referring to FIG. 5, the drawer assembly 20 is freely movable, meaning not attached in any way to the other components or portions of the Murphy bed chest 10. The drawer assembly 20 fits into a drawer opening 42 below the shelf 40 and between the opposing side panels 14. The drawer assembly 20 includes a drawer face 44, two opposing drawer side panels 46, a drawer rear panel 48 opposite the drawer face 44, and a drawer bottom panel 50. Referring now to FIG. 6, in some embodiments, the drawer assembly 20 includes one or more drawer bottom supports 52 extending between the drawer face 44 and the drawer rear panel 48 to support the drawer bottom panel 50. Further, the drawer assembly may include one or more corner supports 54 secured to the drawer rear panel 48 and the drawer side panel 46 to support corners of the drawer assembly 20. The drawer assembly 20 further includes one or more wheels 56 at a bottom of the drawer assembly 20 to allow for easy movement of the drawer assembly 20 between a closed position and an opened position. In the embodiment of FIG. 6, two wheels 56 are secured to each side panel 14, but it is to be appreciated that in other embodiments other quantities of wheels 56 may be utilized. For example, two or three wheels 56 may be utilized.

As stated above, the drawer assembly 20 is freely movable and is not connected to the Murphy bed chest 10 by a typical drawer rail or slide. To improve ease of drawer assembly 20 installation to the Murphy bed chest 10, the drawer assembly 20 includes a drawer guide 58 extending laterally outwardly from the drawer side panel 46, and as shown in FIG. 5 a cabinet guide 60 in the drawer opening 42 extending laterally inwardly from the side panel 14. In some embodiments, the drawer guides 58 are blocks installed to the drawer side panels 46. Similarly, in some embodiments, the cabinet guides 60 are blocks installed to one or both of the side panels 14 or a front rail 62 of the Murphy bed chest 10.

The drawer opening 42 has an opening width 64 greater than a drawer width 106, as measured between the drawer side panels 46. As such, the drawer guide 58 and the cabinet guide 60 aid in aligning the drawer assembly 20 in the drawer opening 42, such that when installed in the Murphy bed chest 10, the drawer assembly 20 is laterally centered in the drawer opening 42. This aligns the drawer assembly 20 with similar features on the front panel assembly 18 for good appearance of the Murphy bed chest 10.

Figure 7:
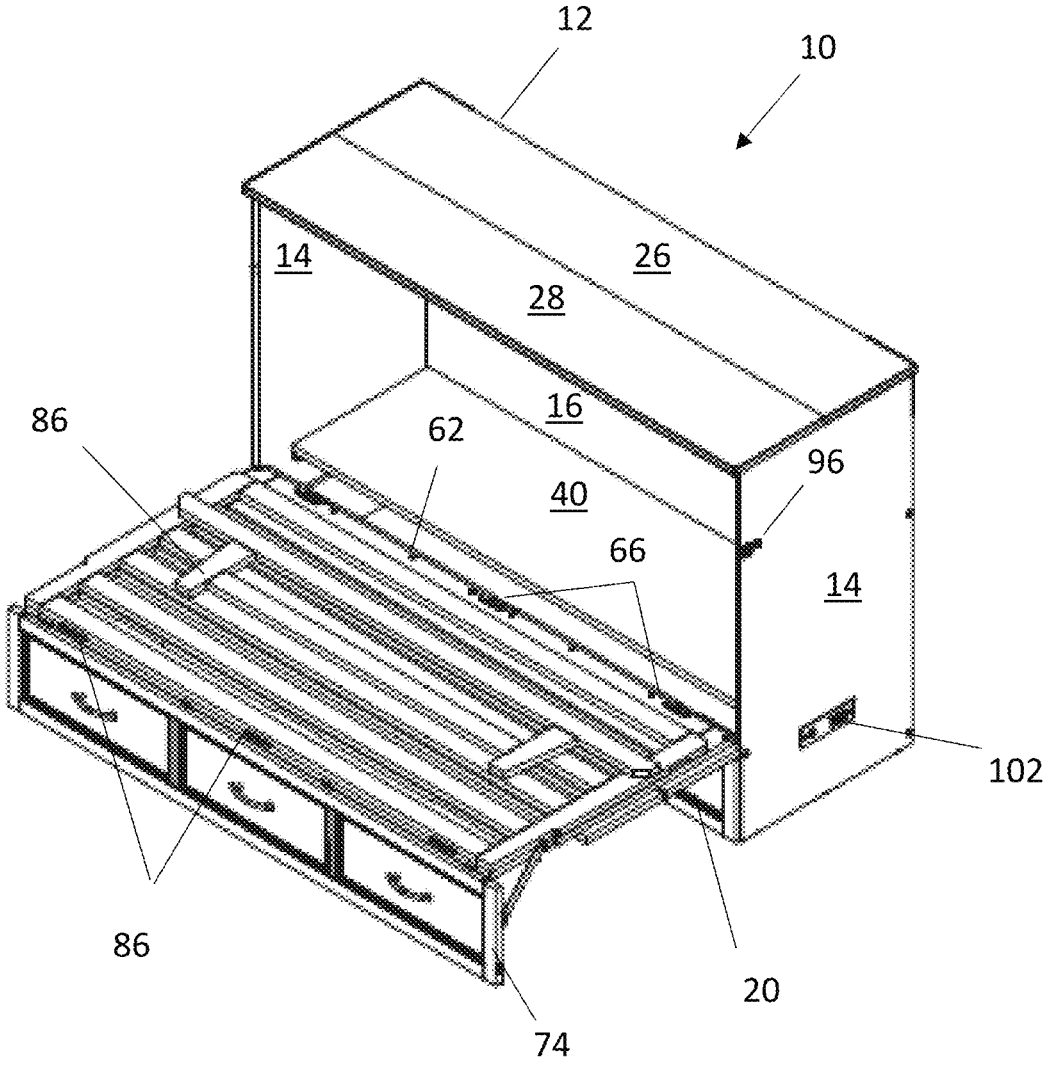
FIG. 7 is an illustration of an embodiment of a Murphy bed chest in a partially opened position.
Figure 8:
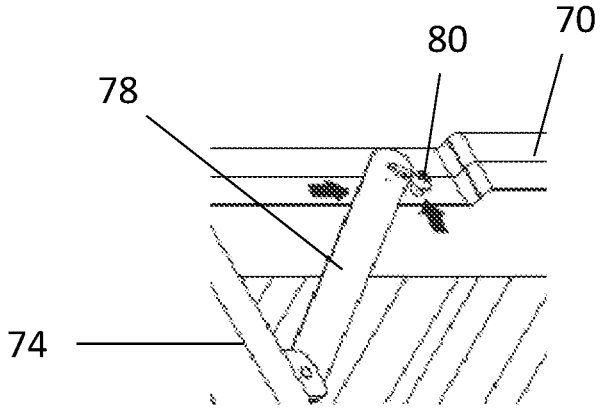
FIG. 8 is an illustration of a brace for an embodiment of a Murphy bed chest.

Referring to FIG. 7, the front panel assembly 18 is connected to the front rail 62 via one or more primary hinges 66, and includes a panel face portion 68 and a frame portion 70 secured to a back side 72 of the panel face portion 68. As shown in FIG. 1, for example, the face portion 68 may be configured to give the appearance of drawers or doors. An upper front panel 74 is connected to the front panel assembly 18 via an upper front panel hinge 76. When the front panel assembly 18 is lowered via the primary hinges 66, the upper front panel 74 rotates away from the front panel assembly 18 on the front panel hinges 76. When in the opened position, such as shown in FIG. 7, the upper front panel 74 is in contact with the floor and provides support for the front panel assembly 18. In some embodiments, a brace 78 is provided to lock a position of the upper front panel 74 when in the open position. As shown in FIG. 8, the brace 78 is pivotably connected to the upper front panel 74 at a first end, and engages a lock feature, such as a pin 80, at a second end of the brace. The pin 80 is secured at, for example, the face portion 68 or the frame portion 70 of the front panel assembly 18.

Referring again to FIG. 2, a footboard frame 82 of the frame portion 70 is connected to a main frame 84 of the frame portion 70 via one or more secondary hinges 86. The footboard frame 82 is rotated relative to the main frame 84 about the secondary hinges 86 to move to the opened position, as shown. Further, a footboard leg 88 is connected to the footboard frame 82 via one or more tertiary hinges 90, and the footboard leg 88 rotates toward the floor when opened to provide support for the footboard frame 82. When in the open position, such as shown in FIG. 2, the frame portion 70 is supported by the front rail 62, the upper front panel 74 and the footboard leg 88, without being supported by the drawer assembly 20. This allows the drawer assembly 20 to be freely movable even when the frame portion 70 is in the opened position. Further, since the drawer assembly 20 is not required for support of the frame portion 70, the drawer 20 may remain in the closed position when the frame portion 70 is moved to the opened position as shown in FIG. 2.

Figure 9:
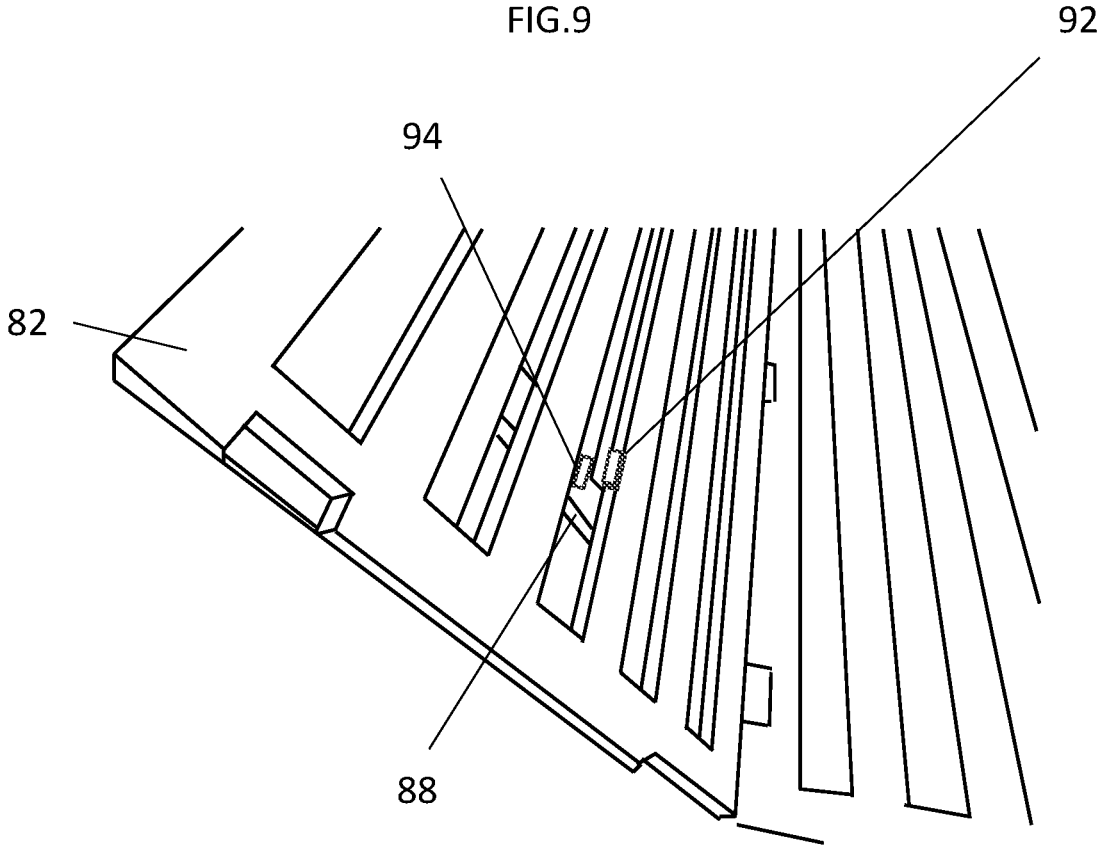
FIG. 9 is an illustration of a magnetic retainer for a footboard leg on an embodiment of a Murphy bed chest.

In some embodiments, the footboard leg 88 is held at a closed position at the footboard frame 82 via a magnet, as shown in FIG. 9. The magnet 92 is located at the footboard frame 82 and is interactive with a plate 94 located at the footboard leg 88. When the plate 94 contact the magnet 92, the footboard leg 88 is retained at the footboard frame 82. When it is desired to extend the footboard leg 88, such as when the footboard frame 82 is moved to the open position, the footboard leg 88 is pulled with a force to overcome a retention force of the magnet 92, thus allowing the footboard leg 88 to be moved to the open position.

Figure 10:
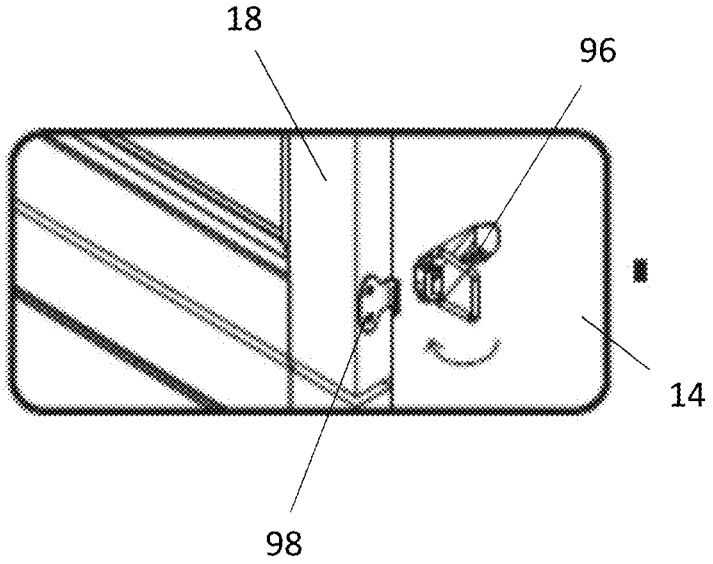
FIG. 10 is an illustration of a latch for an embodiment of a Murphy bed chest.

Referring again to FIG. 1, the Murphy bed chest 10 may include one or more latches 96 to retain the front panel assembly 18 in the closed position. In the embodiment illustrated in more detail in FIG. 10, a latch 96 is located at each side panel 14, and is connectible to a latch hook 98 located on a side surface 100 of the front panel assembly 18. When the latch 96 engages the latch hook 98, the front panel assembly 18 is retained in the closed position. It is to be appreciated that other mechanisms, such as a hook and eye arrangement or the like may be utilized to retain the front panel assembly 18 in the closed position.

Further, as shown in FIG. 1, the Murphy bed chest 100 may include a charging station 102 including, for example, one or more electrical power outlets and/or one or more USB ports for connection of electronic devices (not shown) for, for example, charging of the electronic devices. In the embodiment of FIG. 1, the charging station 102 is located at a side panel 14 of the Murphy bed chest 10, but it is to be appreciated that in other embodiments the charging station 102 may be located at, for example, the top panel assembly 12, or other location of the Murphy bed chest 10.

The Murphy bed chest 10 disclosed herein improves the movement between the closed position and the opened position, and improves offer limited storage or limited access to storage, especially when the bed is in the opened position.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A folding bed chest system, comprising:

a chest assembly, comprising:

two opposing side panels spaced apart by a distance;

a front rail extending across the chest assembly between the opposing side panels;

a front panel assembly connected to the front rail by one or more primary hinges, the front panel assembly movable between an upright closed position and an opened position, such that when in the opened position the front panel assembly is configured to be supportive of a mattress, the front panel assembly, including:

an upper front panel rotatably connected to the front panel assembly, the upper front panel extending from and supportive of the front panel assembly when the front panel assembly is in the opened position; and a frame including:

a main frame portion;

a footboard frame connected to the main frame by one or more secondary hinges; and a footboard leg extending from the footboard frame and supportive of the footboard frame when the front panel assembly is in the opened position;

a drawer assembly disposed below the front rail, the drawer assembly freely movable into and out of a drawer opening disposed below the front panel assembly and between the opposing side panels, the drawer assembly configured such that the front panel assembly is movable from the closed position to the opened position when the drawer assembly is located fully in the drawer opening;

wherein the drawer assembly is not attached in any way to the chest assembly;

wherein the drawer assembly includes:

a drawer face;

a drawer rear panel;

opposing drawer side panels defining a drawer width and extending between the drawer face and the drawer rear panel;

a drawer guide extending laterally outwardly from each of the drawer side panels, the drawer guide interactive with a side panel of the opposing side panels at the drawer opening to center the drawer assembly into the drawer opening, the drawer guide comprising a block secured to the drawer side panel, the drawer guide located closer to the drawer rear panel than to the drawer face, the drawer guide located vertically closer to a bottom of the drawer than to a top of the drawer; and one or more retainers to retain the footboard leg at the footboard frame when the front panel assembly is in the closed position;

wherein the one or more retainers are one or more magnets.

2. The folding bed chest system of claim 1, wherein the drawer assembly further includes one or more wheels affixed to the drawer assembly.

3. The folding bed chest system of claim 1, further comprising a shelf extending between the opposing side panels.

4. The folding bed chest system of claim 3, wherein the shelf is at least partially supportive of the mattress.

5. The folding bed chest system of claim 1, wherein the drawer is movable between a drawer closed position fully in the drawer opening and a drawer opened position fully outside of the drawer opening when the front panel assembly is in the opened position.

6. The folding bed chest system of claim 1, further comprising a latch assembly extending between the side panel and the front panel assembly to retain the front panel assembly in the closed position.

7. The folding bed chest system of claim 1, further comprising a brace to retain the upper front panel in the extended position.

8. The folding bed chest system of claim 1, further comprising a charging station disposed at a side panel, the charging station including one or more electrical power outlets and/or one or more USB ports for connecting one or more electronic devices thereto.

9. The folding bed chest system of claim 1, further comprising a cabinet guide extending laterally inwardly from a side wall of the drawer opening and interactive with the drawer assembly to center the drawer assembly in the drawer opening, the cabinet guide disposed closer to the front panel assembly than to a back side of the chest assembly.

10. A folding bed chest system, comprising:

a cabinet having a front panel assembly movable from a closed position to an opened position, wherein when in the open position the front panel assembly is supportive of a mattress located thereon; and a drawer assembly disposed beneath a front rail of the cabinet, the drawer assembly freely movable into and out of a drawer opening disposed below the front panel assembly, the drawer assembly configured such that the front panel assembly is movable from the closed position to the opened position when the drawer assembly is located fully in the drawer opening;

wherein the drawer assembly is not attached in any way to the chest assembly;

wherein the drawer assembly includes:

a drawer face;

a drawer rear panel;

opposing drawer side panels defining a drawer width and extending between the drawer face and the drawer rear panel; and a drawer guide extending laterally outwardly from each of the drawer side panels, the drawer guide interactive with a cabinet side panel of the cabinet to center the drawer assembly into the drawer opening, the drawer guide comprising a block secured to the drawer side panel, the drawer guide located closer to the drawer rear panel than to the drawer face, the drawer guide located vertically closer to a bottom of the drawer than to a top of the drawer;

a frame including:

a main frame portion;

a footboard frame connected to the main frame by one or more secondary hinges; and a footboard leg extending from the footboard frame and supportive of the footboard frame when the front panel assembly is in the opened position; and one or more retainers to retain the footboard leg at the footboard frame when the front panel assembly is in the closed position;

wherein the one or more retainers are one or more magnets.

11. The folding bed chest system of claim 10, wherein the drawer assembly further includes one or more wheels affixed to the drawer assembly.

12. The folding bed chest system of claim 10, further comprising a shelf disposed in the cabinet, the shelf at least partially supportive of the mattress.

13. The folding bed chest system of claim 10, wherein the drawer is movable between a drawer closed position fully in the drawer opening and a drawer opened position fully outside of the drawer opening when the front panel assembly is in the opened position.

* * * * *